US005799895A

United States Patent [19]

Michaud et al.

[11] Patent Number: 5,799,895

[45] Date of Patent: Sep. 1, 1998

[54] PAPER DISPENSING APPARATUS AND METHOD

[75] Inventors: William C. Michaud, Dubach, La.; James B. Jarrell, Dallas, Tex.; James A. Michaud, Jonesboro, La.

[73] Assignee: Providence Products, Inc., Dallas, Tex.

[21] Appl. No.: 579,117

[22] Filed: Dec. 27, 1995

[51] Int. Cl.[6] ..... B65H 23/06; B65H 16/04; B65H 18/04

[52] U.S. Cl. ..... 242/423; 242/597.5; 242/597.7

[58] Field of Search ..... 242/597.7, 423, 242/597.5, 597.6, 550

[56] References Cited

U.S. PATENT DOCUMENTS

| | | | |
|---|---|---|---|
| 1,101,862 | 6/1914 | Liebeck | 242/598.1 |
| 1,656,464 | 1/1928 | Auren | 242/597.7 X |
| 1,888,426 | 11/1932 | Duby | 242/597.4 |
| 1,924,088 | 8/1933 | Bowles | 242/421.9 |
| 2,486,678 | 11/1949 | Rashco | 242/55.2 |
| 2,513,699 | 7/1950 | Williams | 242/55.2 |
| 2,555,531 | 6/1951 | Boord | 242/597.7 X |
| 2,994,488 | 8/1961 | Waddell | 242/55.2 |
| 3,061,217 | 10/1962 | Grant | 242/55.2 |
| 3,227,386 | 1/1966 | Pitcher | 242/597.5 |
| 3,228,618 | 1/1966 | Bracken | 242/55.2 |
| 3,295,777 | 1/1967 | Carroll | 242/597.7 |
| 3,370,805 | 2/1968 | Barbee | 242/597.7 X |
| 3,806,057 | 4/1974 | Whatley | 242/55.54 |
| 3,923,265 | 12/1975 | Krueger | 242/55.2 |
| 4,149,680 | 4/1979 | Whatley | 242/55.2 |
| 4,218,027 | 8/1980 | Pool | 242/55.2 |
| 4,273,299 | 6/1981 | Ness | 242/55.54 |
| 4,762,288 | 8/1988 | Eckels | 242/55.2 |
| 4,824,038 | 4/1989 | Chandler | 242/55.2 |
| 4,877,195 | 10/1989 | Smith | 242/55.1 |
| 5,009,313 | 4/1991 | Morand | 206/391 |

*Primary Examiner*—John Q. Nguyen
*Attorney, Agent, or Firm*—David S. Alavi

[57] ABSTRACT

A rolled paper dispensing apparatus for securing a paper roll on a surface, which apparatus includes a base plate fitted with a friction-inducing area or areas and at least one roll spindle projecting from the base plate for receiving a roll of paper towels, toilet paper or like rolled paper product, and dispensing paper in selected lengths by rotation of the roll on the roll spindle. The rolled paper product or paper roll is placed on the roll spindle, resting lightly on the base plate friction-inducing area(s). The dispensing mode is initiated by grasping the leading sheet edge of the paper roll and pulling the leading sheet edge in a controlled unwinding of the paper roll while maintaining the paper roll in a position of least rotational resistance by disengaging the paper roll from the friction-inducing area(s), thus allowing controlled rotation of the paper roll on smooth surfaces of the base plate and smooth edges of the roll spindle. The tearing mode is initiated by directing user force to position the paper roll in a tilted position of greatest resistance to rotation and engage the bottom edge of the paper roll with friction-inducing edges of the roll spindle and the bottom edge of the paper roll with the friction-inducing area(s) to impede rotation of the paper roll and facilitate tearing of the selected paper sheet from the paper roll, typically along a perforated line.

18 Claims, 3 Drawing Sheets

PAPER DISPENSING APPARATUS AND METHOD

BACKGROUND OF THE INVENTION

1. Field of the Invention

This invention relates to dispensing devices for dispensing rolls of paper towels, toilet paper and like rolled paper products or paper rolls and more particularly, to a rolled paper dispensing apparatus which facilitates superior user control over paper roll rotation to dispense paper from the roll and move the paper roll from a position of least resistance to rotation to a position of maximum resistance to rotation. The apparatus is characterized by a base plate for resting on or attachment to a fixed surface, one or more friction-inducing areas, such as a rubber or dimpled strip, serrated bar or blade or the like, provided on or projecting from the extending and/or an edge or other area of the base plate and a roll spindle of selected shape and length projecting upwardly from the base plate. The roll dispensing holder is constructed to facilitate removing a sheet of paper of selected length from a paper roll positioned on the roll spindle by grasping the free end and leading edge of the paper roll, and unwinding the sheet of paper from the paper roll on the roll spindle while maintaining the paper roll in a position of least rotational resistance. This controlled unwinding of the paper sheet is accomplished as the paper roll is disengaged from the friction-inducing area(s) on the base plate to facilitate convenient, reduced-friction extension and unwinding of the paper sheet from the paper roll. Subsequent application of downward force on the paper sheet facilitates tilting of the paper roll on the roll spindle to engage the paper roll and roll core with the friction--inducing areas and impede further rotation of the paper roll with respect to the roll spindle by this friction-inducing device and allows tearing of the selected length of paper from the paper roll.

One of the problems which exists in conventional paper roll dispensers for dispensing rolled paper such as paper towels, toilet paper and the like, is the tendency of the paper to stream from the roll in uncontrolled quantities when grasped and pulled by the user. Another problem is pulling the entire roll of paper from the bracket upon which it is mounted when attempting to dispense a sheet of paper of selected length from the roll. In most roll paper dispensing device designs there is no facility or mechanism for easy loading, unloading and controlled streaming of the paper from the roll or compensating for irregularities and variation in paper quality, thickness, perforation, tightness of wind, cylindrical core size and condition and the like, thereby and rendering the controlled dispensing of a desired length of paper from the roll, difficult.

This invention represents an improvement in the loading, dispensing and tearing of perforated, as well as many non-perforated rolled paper products, each of which has its own unique unwinding and tear characteristics. The device is designed to facilitate controlled removal of selected lengths of perforated or unperforated paper sheets from paper rolls of varying thickness, quality, perforation, tightness of wind, core size and condition, as heretofore described. The loaded paper roll rests in a semi-disenage position (in a lesser rotational resistance position) leaning at about 85 degrees, away from the highest friction areas. There are three main phases in selecting sheets from the paper roll: (1) Loading or unloading, (2) dispensing and unwinding; and (3) tearing a paper sheet from the paper roll. The center of the paper roll should be displayed in a well-lit area where the user stands facing the paper roll. In use, one hand typically unrolls the paper sheet across the user's view to locate the perforation line and downward force applied to the leading end of the paper roll moves the paper roll into contact with the greatest frictional zones to provide adequate frictional resistance to roll rotation for tearing the paper from the paper roll at the perforation line.

2. Description of the Prior Art

Various dispensing devices are known in the art. Typical of these devices is the "Paper Serving Apparatus" detailed in U.S. Pat. No. 1,101,862, dated Jun. 30, 1914, to H. Liebeck. The device includes a spring-loaded spool mounted on a frame for receiving a roll of paper such as to-let paper. The spool may be quickly and easily released from the frame by operation of a knob attached to a rod extending through the spring. U.S. Pat. No. 1,888,426, dated Nov. 22, 1932, to J. F. Duby, details a "Holder For Rolls of Paper". The holder includes a frame, upon which is mounted a rotatable spool fitted with a key for unlocking the spool from the frame and accommodating a roll of paper such as toilet paper. U.S. Pat. No. 1,924,088, dated Aug. 29, 1933, to H. Bowles, et al, details a "Roll Paper Holder" which includes a ratchet device fitted on a frame and mounted in cooperation with a spool for receiving a roll of paper towel or toilet paper to facilitate incremental dispensing of lengths of paper towel or toilet paper from the spool. A "Tissue Holder" is detailed in U.S. Pat. No. 2,486,678, dated Nov. 1, 1949, to J. Rashko. The tissue holder includes a one-piece bracket and paper roll support element, which support element includes an upward-standing flange at one end. The paper roll is fitted over the upward-standing flange to rotatably rest on the support element for dispensing. A "Paper Roll Holder and Method of Making Same" is detailed in U.S. Pat. No. 2,513,699, dated Jul. 4, 1950, I. A. Williams. The holder includes a one-piece bracket adapted for mounting on a vertical wall and fitted with an upward-standing flange terminating at one end of a support element, which support element receives a paper roll and is of such width to impede rotation of the roll and effect selected dispensing of the paper from the roll. U.S. Pat. No. 2,994,488, dated Aug. 1, 1961, to Y. V. Waddell, details a "Roll Material Dispenser" characterized by a flat base plate having an upward-standing spindle extending in angular relationship from the base plate. A mandrel extends from the spindle for receiving a roll of paper towels or other paper roll and the mandrel is shaped such that rotation of the roll is impeded, thereby facilitating selected dispensing of the paper from the roll on demand. A "Toilet Paper Holder" is detailed in U.S. Pat. No. 3,061,217, dated Oct. 30, 1962, to J. J. Grant. The toilet paper includes an L-shaped bracket for rotatably receiving a roll of paper such as toilet paper, which bracket is mounted on a sliding plate that fits over an opening in the wall to facilitate enclosing the paper roll and bracket in the opening when not in use and extension of the bracket and paper roll from the opening when in use. U.S. Pat. No. 3,227,386, dated Jan. 4, 1966, to M. D. Pitcher, details a "Holder For Toilet Tissue Rolls or the Like", which includes a round base plate mounted on a vertical surface and having a pair of extending rods connected at the ends, projecting from the base plate. A roll of paper such as a paper towel or toilet paper is rotatably seated on the spaced rods for dispensing. U.S. Pat. No. 3,228,618, dated Jan. 11, 1966, to W. A. Bracken, details a "Tissue Holder" having a mounting flange provided with an extending mandrel or support for rotatably supporting a roll of paper and a clip for attaching the device to the water closet of a commode. A "Roll Holder" is detailed in U.S. Pat. No. 3,806,057, dated Apr. 23, 1974, to B. E. Whatley. The holder has a first extension arranged for detachable connection to a bracket secured on an upright wall surface and includes a second extension projecting downwardly through the center of the roll, forming a spindle for guiding rotation of the roll. A base is secured on the counter surface to hold the roll off the counter and the base may have a side extension formed into a soap holder. U.S. Pat. No. 3,923,265, dated Dec. 2, 1975, to Krueger, et al, details a "Paper Towel Holder". The holder includes a mounting bracket having a portion normal to the bracket that cantilevers outwardly from the bracket and mounts a spindle. One end of the spindle is fixed to the cantilevered portion of the bracket and is disposed within or secured to an outwardly-projecting portion which includes a hole for venting purposes. The spindle is hollow and adapted for receiving a rod therein. The end of the rod is provided with a handle portion which includes a disc and a projection that may be grasped by the hand of the user. U.S. Pat. No. 4,149,680, dated Apr. 17, 1979, to B. E. Whatley, details a "Paper Roll Holder". The paper roll holder includes a body member having an arm leading angularly outwardly from the body member and a spindle leads from the arm in parallel relationship with respect to the body member. The spindle has an upwardly-extending retainer or hook on the end for engaging the edge of a core upon which the paper roll is wound, to restrain rotation of the roll. The spindle is angled rearwardly to cause the core of the roll to frictionally engage both the top and bottom edges of the spindle and further restrain turning movement of the roll. The spindle may also have a rearward projection which acts as a stabilizer and further restrains movement of the paper roll. An edge of the spindle can be serrated to restrain rolling movement or a semi-circular serrated projection can form a part of the spindle to restrain rolling movement of the paper roll. U.S. Pat. No. 4,218,027, dated Aug. 19, 1980, to Dan L. Pool, details a "Dispenser For Paper Roll". The dispenser includes EL spindle fixed at one end to a pedestal which projects from the front side of a base. The back side of the base is secured to a vertical or horizontal surface, with the spindle horizontal and extending through the hollow core of a roll of coiled paper sheet. The roll is retained by a projection extending radially from the cap, carried at the free end of the spindle. The cap is rotatable to orient projection of the roll upwardly, regardless of the mounting position of the base. A "Holder For Rolls of Paper" is detailed in U.S. Pat. No. 4,273,299, dated Jun. 16, 1981 to Ness. The holder includes a stationary base member having an annular, flat rim surrounding a central, frustoconical projection. A rotatable member has an annular flat rim surrounding the frustoconical projection that nests around the projection of the base member and is rotatable with respect to the base member. The facing flat surfaces of the rim and facing surfaces of the projections enable relative rotation with some resistance, to provide a breaking action. The outer surface of the frustoconical projection of the rotatable member includes a series of yieldable projections for firmly, non-rotatably engaging the hollow core of a paper towel roll or toilet paper roll. The base member is secured horizontally, so that the rotatable member stands vertically and holds the paper roll in a vertical position. U.S. Pat. No. 4,762,288 dated Aug. 9, 1988, to Robert E. Eckels, details a "Holder For Rolled Products and the Like". The holder includes a U-shaped bracket having a base member for attachment to a vertical support surface and outwardly-extending support members, each having an aligned, conical-shaped support shaft on the bottom member while the top member has a downwardly-extending retainer shaft. The top shaft retains the roll in a vertical position while the bottom shaft supports the roll and includes surfaces and edges to provide a desired coefficient of friction to the retained roll and permit controlled dispensing from the roll. The bottom support shaft may also have an outwardly-extending edge, upon which the roll rests to add additional friction during the dispensing operation. Various configurations and surface treatment are provided for the various support shafts and retaining shafts. U.S. Pat. No. 4,824,038, dated Apr. 25, 1989, to Jerry W. Chandler, details a "Holder For Rolled Paper" which includes a frame adapted to be attached to a vertical support wall in a cylindrical core which pivotally engages the lower extremity of the frame. The core can be swung at a vertical path between a vertical position and a horizontal position and can be removed from the frame. The retaining structure holds a non-pivoting extremity of the core in vertical position within the frame. A "Rolled Web Holder" is detailed in U.S. Pat. No. 4,877,195, dated Oct. 31, 1989, to Charles A. Smith. The holder includes a base member for attachment to a supporting base apparatus, with a generally T-shaped bracket extending laterally therefrom. The bracket is planar and includes a leg base attached to the base member and a laterally-extending arm member of selected width, a first generally planar support having an aperture therein generally conforming to the cross-sectional periphery of the arm member to be received therein and rests on the leg base, where the width of the arm is generally equal to the diameter of the core of the web material. A second cover member is provided, having a geometric configuration generally congruent to the geometric configuration of the outer periphery of the web material and having an opening therein and having a geometric configuration generally similar to the geometric configuration of the periphery of the cross-section of the arm member. U.S. Pat. No. 5,009,313, dated Apr. 23, 1991, to Michael Morand, details a "Bathroom Tissue Dispenser" [spindle release]. The device includes a two-roll toilet paper dispenser having a vertical spindle with a stop apparatus part way up the spindle. The stop apparatus divides the spindle into a lower portion upon which the first toilet paper roll is mounted in an operative position and an upper portion upon which the second toilet paper roll is mounted in a storage position. An actuating mechanism is provided for operating the stop mechanism to permit a roll resting thereon in the storage position to drop down the spindle to the operative position.

It is an object of this invention to provide a new and improved dispensing mechanism for dispensing paper sheets from rolled paper products, which mechanism facilitates optimum user control and includes a base resting on a suitable surface and having one or more friction-inducing area(s) or projection(s), or the like thereon and an upward-standing roll spindle of selected geometric cross-section and length, for receiving a roll of paper product or paper roll such as a paper towel or toilet paper roll. Pulling the leading paper sheet from the paper roll substantially disengages the paper roll from the friction-inducing area(s) or projection(s) to facilitate easy and controlled rotation of the paper roll on the roll spindle and dispensing of the paper sheet from the roll. Application of downward force to the extended paper sheet tilts the paper roll on the roll spindle to frictionally engage the paper roll with the friction-inducing area(s) or projection(s), impede rotation of the roll on the roll spindle and facilitate tearing and dispensing of a selected quantity of paper sheet from the paper roll.

Another object of this invention is to provide a rolled paper dispensing holder or apparatus characterized by a base fitted with a roll spindle to facilitate orientation of a roll of paper product rotatably on the roll spindle. Paper sheets of selected length are dispensed from the paper roll by pulling the paper sheets from the roll as the paper roll rotates on the roll spindle. Subsequent downward pressure applied to the extending paper sheet binds the paper roll on the roll spindle, thus retarding rotation of the paper roll and allowing the paper sheet to be torn from the paper roll.

A still further object of this invention is to provide a roll dispensing holder or apparatus characterized by a base plate for mounting or resting on a surface and a roll spindle of selected length and cross-sectional configuration and having dull or smooth, friction-reducing top front and bottom rear core-engaging surfaces, sharp or friction-reducing top rear, core-engaging edges and a sharp or friction-inducing bottom front core-engaging edge, the roll spindle extending from the base plate for receiving a roll of paper towel, toilet paper, or other rolled paper product having a cylindrical core, typically longer than the roll spindle. When a sheet of paper on the paper roll is grasped and pulled toward the user, the cylindrical core of the paper roll engages the smooth top front and bottom rear surfaces on the roll spindle to facilitate substantially free, yet controlled, rotation of the paper roll on the roll spindle responsive to dispensing of a selected quantity of the paper sheet from the paper roll. When downward pressure is applied to the extended paper sheet, rotation of the paper roll on the roll spindle is impeded by engagement of the cylindrical roll core with the sharp or friction-inducing top rear edges and bottom front edge of the roll spindle to facilitate tearing of the selected length of paper from the paper roll.

Yet another object of this invention is to provide a roll dispensing apparatus which is characterized by a generally L-shaped bracket preferably mounted on a fixed vertical surface by means of an adhesive strip or fasteners. The bracket is fitted with an upward-standing roll spindle of selected length and cross-sectional configuration, with sharp or friction-inducing, rough or rubber-coated top rear and bottom front edges and smooth top front and bottom rear edges, for receiving a rolled paper product or paper roll such as paper towel and toilet tissue, with the rolled paper product maintained on the roll spindle by gravity. An additional friction-inducing area or areas, such as a rubber strip, dimpled or roughened area, elevated friction blade or the like, may be provided on the bracket in lieu of or in addition to the roll spindle friction-inducing areas. Paper is dispensed from the paper roll by initially pulling a sheet of paper from the paper roll with a slightly upward force and tilting the top of the rolled paper product rearwardly on the roll spindle away from the friction area(s) to engage the paper core with the smooth top front and bottom rear roll spindle edges and facilitate substantially free, yet controlled rotation of the rolled paper product on the roll spindle. Tearing of the extended paper sheet from the paper roll is effected by applying a downward force on the sheet, tilting the top of the rolled paper product on the roll spindle forwardly in the direction of pull, for engagement of the cylindrical core with the sharp or friction-inducing top rear edges and bottom front edge of the roll spindle and the bottom edge of the rolled paper product and the cylindrical core with the friction area(s) on the bracket, to impede rotation of the paper roll on the roll spindle and complete tearing of a selected length of paper from the paper roll.

SUMMARY OF THE INVENTION

These and other objects of the invention are provided in a new and improved, binding and/or single or dual friction-controlled rolled paper dispensing holder or apparatus which facilitates precise attitudinal and rotational control and tearing of paper of selected length from a wide variety of rolled paper products. The rolled paper dispensing apparatus includes, in a first preferred embodiment, a base and a roll spindle extending from the base for receiving the paper roll. In another preferred embodiment the roll spindle and/or base include friction-inducing areas or elements. In yet another preferred embodiment the dispensing apparatus is characterized by a mounting bracket fitted with a pair of adhesive strips and/or several mount openings for receiving fasteners and securing the mounting bracket to a fixed horizontal or vertical surface; a base plate extending from the mounting bracket at an angle of about 85 degrees and having at least one edge fitted with an elongated, friction-inducing area or projection; and a roll spindle having a selected geometric cross-section and length, projecting vertically (in the case of vertical mounting) and horizontally (in the case of horizontal mounting) from the mounting bracket adjacent to the friction-inducing area(s) or element(s) to receive the paper roll. Dispensing of a desired length of paper from the paper roll is effected by a rocking action of the paper roll with respect to the mounting bracket, as heretofore described.

BRIEF DESCRIPTION OF THE DRAWINGS

The invention will be better understood by reference to the accompanying drawings, wherein.

DESCRIPTION OF THE PREFERRED EMBODIMENTS

Figure 1:
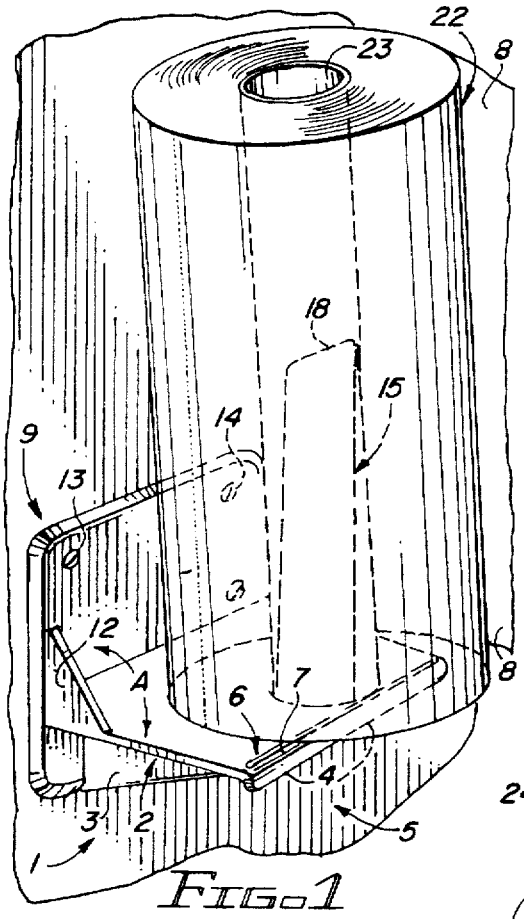
FIG. 1 is a perspective view of a preferred embodiment of the paper dispensing apparatus of this invention, with a roll of paper towels mounted for rotation on the paper dispensing apparatus.
Figure 2:
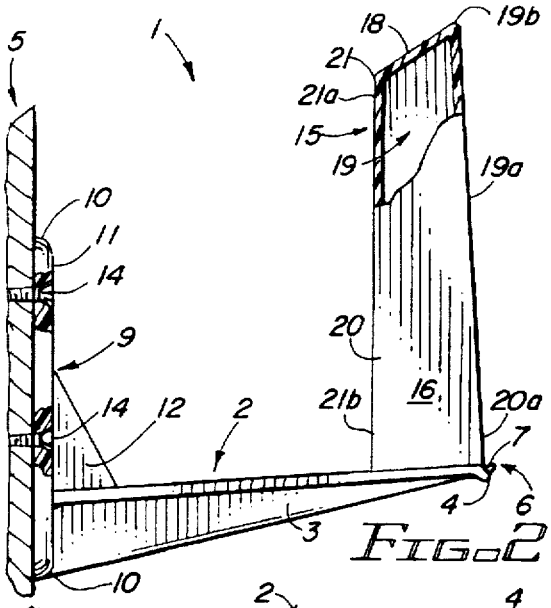
FIG. 2 is a side view of the paper dispensing apparatus illustrated in FIG. 1 with the paper roll removed.
Figure 3:
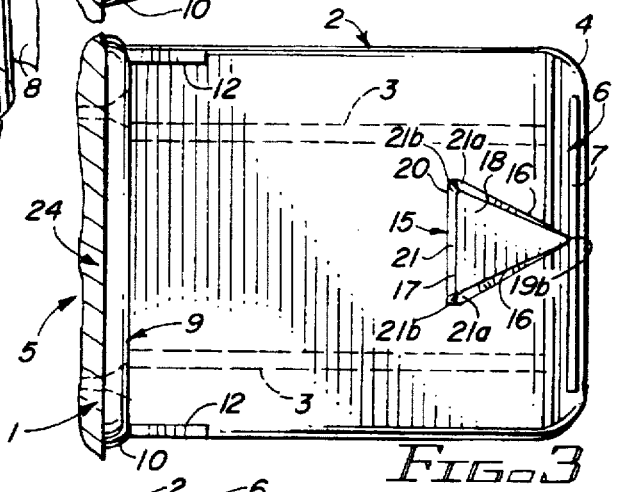
FIG. 3 is a top view of the paper dispensing apparatus illustrated in FIG. 2 with alternative adhesive strip mounting.
Figure 4:
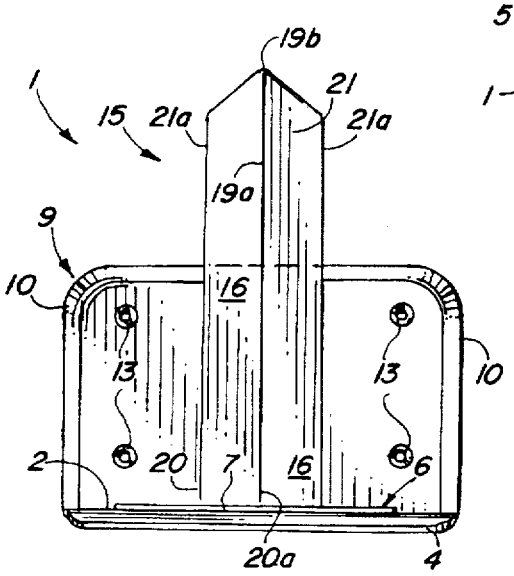
FIG. 4 is a front view of the paper dispensing apparatus illustrated in FIG. 2, with the bottom edge of the mounting bracket coterminal with the mounting bracket, for flush-mounting against a horizontal surface.

Referring initially to FIGS. 1–4 of the drawings, in a preferred embodiment the roll dispensing apparatus of this invention is generally illustrated by reference numeral 1. The roll dispensing apparatus 1 includes a flat base plate 2, extending from a mounting bracket 9 at an acute angle, preferably in the range of from about 75 degrees to about 90 degrees, with an elongated friction blade 6 provided on the downwardly-projecting, curved and extending end of the base plate 2, as illustrated in FIG. 2. In one aspect of this preferred embodiment, plate gussets 3 are provided on the bottom of the base plate 2 and extend to the mounted bracket 9 for support of the base plate 2, as illustrated in FIGS. 1–3. Alternatively, the plate gussets 3 may be removed, along with that portion of the mounting bracket 9 which extends below the base plate 2, to allow flush mounting against a horizontal surface (not illustrated) adjoining the supporting surface 5, as illustrated in FIG. 4. A tapered, triangular roll spindle 15, which is shorter than the paper roll 22, projects upwardly from the base plate 2 adjacent to the friction blade 6, as further illustrated in FIGS. 1–3. In a most preferred embodiment of the invention the spindle base 20 of the generally triangular-sectioned roll spindle 15 is larger than the spindle top 21, as illustrated in FIG. 2, thus defining the tapered shape of the triangular roll spindle 15. In another preferred embodiment the triangular roll spindle 15 is characterized by adjacent spindle front walls 16, which join at a leading edge 19*a* that is perpendicular to the base plate 2, and an adjoining spindle rear wall 17, and the spindle top 21 includes a truncated or bevelled top surface 18, as further illustrated in FIG. 2. The triangular roll spindle 15 may be hollow and thereby characterized by a spindle interior 19, as desired. Moreover, the top segments of the junctions between the spindle front walls 16 and the spindle rear wall 17 are defined by sharp top edges 21*a*, while the bottom of the leading edge 19*a* terminates in a sharp bottom edge 20*a*, to induce friction on the paper roll 22, as hereinafter described. Conversely, the dull bottom segments 21*b* of the junctions between the spindle front walls 16 and the spindle rear wall 17 and the dull top edge 19*b* of the triangular roll spindle 15, are smooth, to retard friction on the paper roll 22.

Referring again to FIGS. 1 and 2 of the drawings, in one embodiment, the friction blade 6 has a relatively sharp blade edge 7 which projects outwardly from the downwardly-curved base plate tip 4. Furthermore, the friction blade 6 is most preferably disposed at the base of the apex or leading edge 19*a*, as illustrated in FIG. 2, for purposes which will be hereinafter further described. In another preferred embodiment a pair of flange gussets 12 are provided between the base plate 2 and the mounting bracket 9 to further stiffen and support the base plate 2 with respect to the mounting bracket 9 and to insure, where desirable, that the base plate 2 is constrained to remain in a selected acute angular relationship with respect to the mounting bracket 9, which angular relationship is most preferably about 85 degrees. Alternatively, the base plate 2 may extend from the mounting bracket 9 without the flange gussets 12 and/or the plate gussets 3, as illustrated in FIG. 4, under circumstances where flexibility is desired to aid in binding the paper roll 22 on the shorter roll spindle 15 when dispensing paper. Four fastener openings 13 may provide in the mounting bracket 9 for receiving fasteners 14 and securing the flat rear surface of the mounting bracket 9 to a vertical supporting surface 5. Alternatively, an adhesive strip 24 may be used to effect the same purpose, as illustrated in FIG. 3. The opposite, or front surface of the mounting bracket 9 is characterized by a curved base 11 and the mounting bracket 9 further includes tapered edges 10, as illustrated in FIGS. 2 and 3, for cosmetic purposes.

Figure 5:
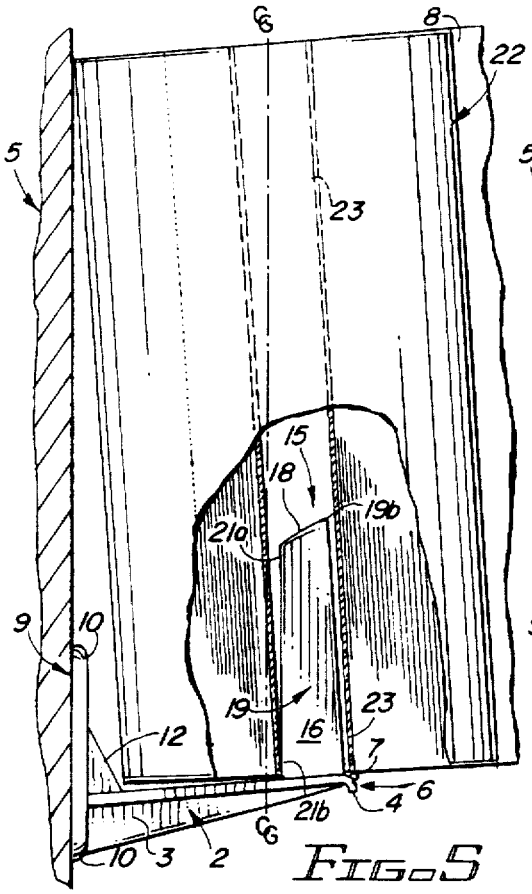
FIG. 5 is a side view of the paper dispensing apparatus illustrated in FIG. 1, with the roll of paper towels tilted rearwardly into freely-rotating, paper-dispensing mode.
Figure 6:
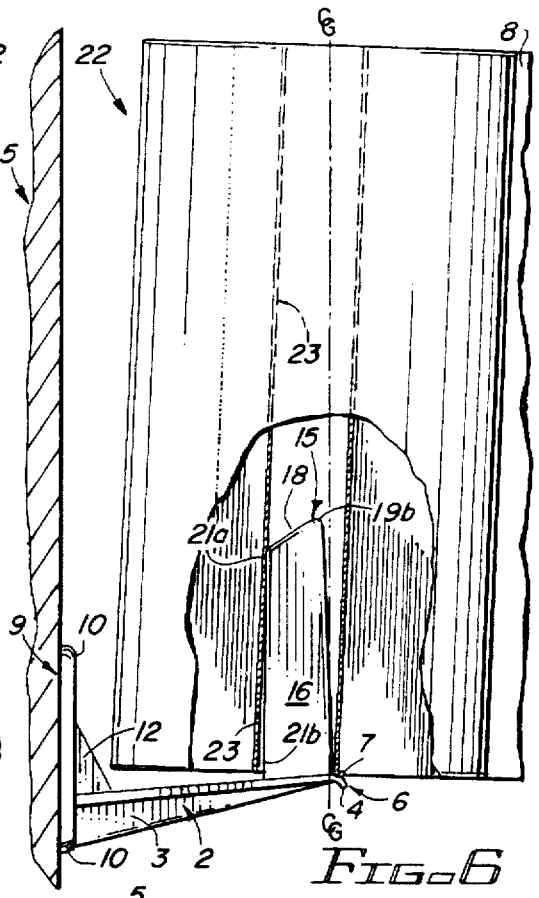
FIG. 6 is a side view of the paper dispensing apparatus illustrated in FIG. 1, with the roll of paper towels tilted forward into removal mode.

Referring now to FIGS. 1, 5 and 6 of the drawings, for purposes of illustration the rolled paper product or paper roll 22, such as a roll of paper towels is fitted with a conventional cylindrical core 23 and may be positioned vertically on the essentially vertically-oriented, shorter triangular roll spindle 15. When the paper roll 22 is positioned on the triangular roll spindle 15 as illustrated in FIG. 1, it is maintained in position by gravity and a length of paper sheet 8 may be pulled from the paper roll 22 by exerting force on the paper sheet 8 while the paper roll 22 is resting on the base plate 2 as illustrated in FIG. 5. When the paper roll 22 is in this position an inside surface area of the cylindrical core 23 is resting against the smooth, dull, friction-reducing top edge 19*b* of the leading edge 19*a* and the smooth, dull, friction-reducing bottom edges 21*b* of the spindle base 20 of the triangular roll spindle 15 as the bottom edge of the cylindrical core 23 and the paper rolled on the cylindrical core 23, are seated against the base plate 2. This friction-reducing engagement of the paper roll 22 with the base plate 2 and triangular roll spindle 15 of the roll dispensing apparatus 1 and disengagement with the friction blade 6 is best facilitated when the angle "A" illustrated in FIG. 1 is about 85 degrees, measured between the base plate 2 and the mounting bracket 9. Extension of a length of paper sheet 8 of selected length from the paper roll 22 is therefore easily measured without uncontrolled "streaming", by controlled rotation of the paper roll 22, as the cylindrical core 23 easily, but not excessively freely, rotates on the smooth contact surfaces of the triangular roll spindle 15 against the base plate 2, due to disengagement of the bottom edge of the cylindrical core 23 and the paper rolled thereon with the friction-inducing blade edge 7 of the elongated friction blade 6, as further illustrated in FIG. 5. When a desired length of paper sheet 8 is extended from the paper roll 22, downward pressure is applied to the unrolled and extended paper sheet or sheets, thus tilting the paper roll 22 forwardly on the triangular roll spindle 15 away from the mounting bracket 9 and toward the user, to the configuration illustrated in FIG. 6. When the paper roll 22 is in this position, the cylindrical core 23 is placed in a bind on the shorter roll spindle 15 and may be slightly deformed as the interior of the cylindrical core 23 rests against the parallel, sharp top edges 21*a* of the opposite side of the spindle top 21 of the triangular roll spindle 15 and the bottom edge of the cylindrical core 23 engages the sharp bottom edge 20*a* of the leading edge 19*a* of the roll spindle 15. The cylindrical core 23 and the paper rolled thereon also engage the blade edge 7 of the friction blade 6, thus impeding further rotation of the paper roll paper 22 and allowing easy tearing of the extended length of paper sheet 8 from the paper roll 22.

Figure 7:
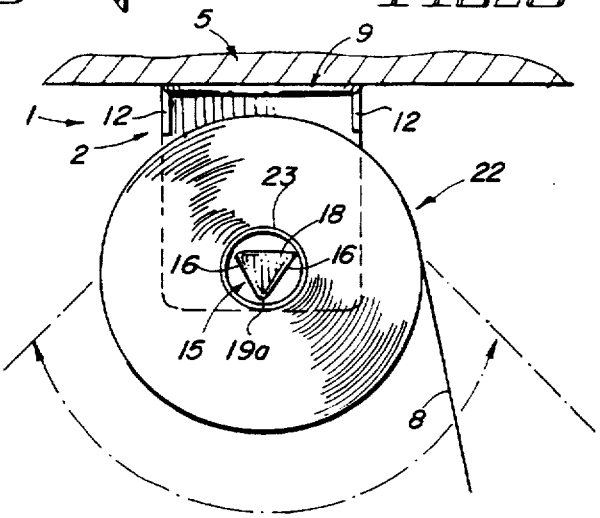
FIG. 7 is a top view of the paper dispensing apparatus illustrated in FIG. 1, more particularly illustrating a preferred directional pulling area of the leading edge of the dispensed paper product from the paper roll.

Referring now to FIG. 7 of the drawings, the directional pulling area of a length of paper sheet 8 from the paper roll 22 is illustrated, considering that the paper sheet 8 may be dispensed from either vertical edge of the paper roll 22, depending upon its orientation on the triangular roll spindle 15. Accordingly, it will be appreciated from consideration of FIG. 7 that the controlled tearing of a selected length of paper sheet 8 from the paper roll 22 is facilitated over a wider pulling area than has heretofore been possible without the tilting or rocking action of the paper roll 22 on the roll dispensing apparatus 1. This facility allows the roll dispensing apparatus 1 to be mounted in a traditionally unsuitable, confined or dark area, for example, on the back of a cabinet door having limited access, and the design thus allows more facility for user area and creates less paper dust.

Figure 8:
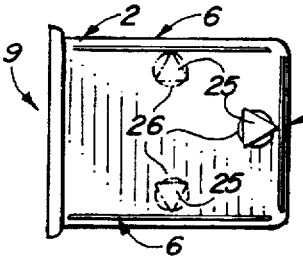
FIG. 8 is a top view of the paper dispensing apparatus equipped with optional cylindrical and triangular-shaped roll spindles in various locations on the base plate.
Figure 9:
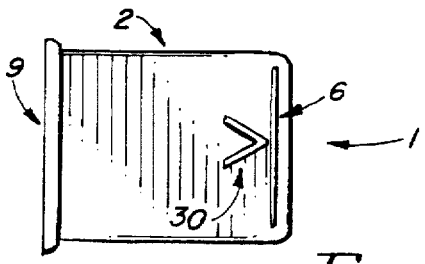
FIG. 9 is a top view of the paper dispensing apparatus provided with an open V roll spindle provided on the base plate.
Figure 10:
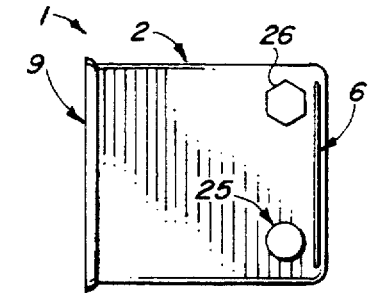
FIG. 10 is a top view of the paper dispensing apparatus illustrated in FIG. 8, featuring a round roll spindle and a hexagonal roll spindle on the base plate.

Referring next to FIGS. 8–10, it will be appreciated that the paper dispensing apparatus of this invention may be fitted with roll spindles of varying cross-sectional configuration, length, number and size, including a selected combination of shapes, such as a large top and small bottom segment, as illustrated in FIG. 8, depending upon the diameter, character, length and number of the paper roll or rolls 22 to be mounted. Although the triangular cross-sectional configuration of the triangular roll spindle 15, illustrated in FIGS. 1–4, is preferred because of superior binding action, the round roll spindle 25, open-V roll spindle 30, hexagonal (polygonal) roll spindle 26 and combination roll spindles illustrated in FIGS. 8–10 are also applicable. Furthermore, the friction blade 6, or alternative friction strip or area can be located in several positions on the base plate 2, as illustrated in FIG. 8. This friction device can be a rough surface such as unsanded wood or roughened plastic, rubber or the like, as well as a friction blade 6, in non-exclusive particular, according to the knowledge of those skilled in the art.

Figure 11:
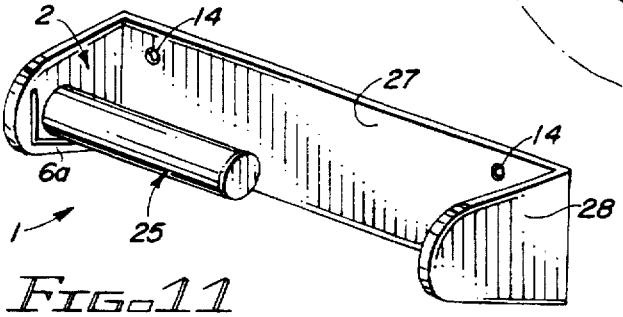
FIG. 11 is a perspective view of the paper dispensing apparatus horizontally mounted in a dispensing rack.

FIG. 11 illustrates a typical horizontal mounting of the paper dispensing apparatus 1, wherein the base plate 2 is shaped in a horizontally-positioned, preferably plastic, dispensing, rack 27, having a deformable retaining flange 28 for maintaining a paper roll (not illustrated) on the horizontal round roll spindle 25. Friction strips **6*a* are applied to or provided on the base plate 2 to impede rotation of the paper roll in the manner described above. Alternatively, one or more friction blades 6 may be provided on the base plate 2 in lieu of the friction strip or strips 6*a***.

Referring again to FIG. 2 of the drawings, the angle of deployment of the base plate 2 from the mounting bracket 9 can be selected within substantially any acute angle range, to determine the degree of forward "rocking", wobble, tilt or pivot necessary to properly facilitate rotation of the paper roll 22 in either direction and tearing of a length of paper sheet 8 from the paper roll 22 when the paper roll 22 is "rocked", wobbled, tilted or pivoted in the rearward and forward positions, respectively, as illustrated in FIGS. 5 and 6 and described above. However, in a most preferred embodiment of the invention it has been found that the angle "A" existing between the base plate 2 and the mounting bracket 9 is preferably about 85 degrees. Moreover, as illustrated in FIG. 11, one or more friction strips **6*a* or an alternative friction-inducing surface or surfaces or materials known to those skilled in the art may be used in place of the friction blade 6, as heretofore described. These friction-inducing surfaces may be applied not only to the extending base plate tip 4, but also to one or both edges or in other areas of the base plate 2, to facilitate a selected area of tear of the paper sheet 8 from a paper roll 22 of specific character, as illustrated in FIG. 7**.

Figure 12:
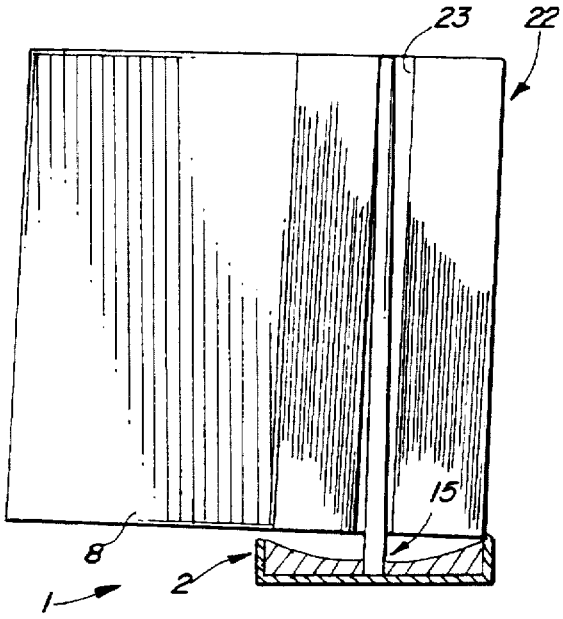
FIG. 12 and 13 are side sectional views of a free-standing paper dispensing apparatus fitted with a long roll spindle.
Figure 13:
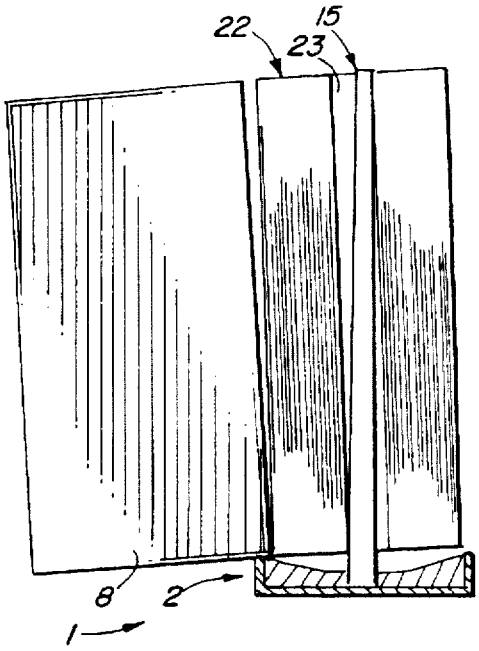

Referring now to FIGS. 12 and 13 of the drawings, in another preferred embodiment of the invention the base plate 2 of the paper dispensing apparatus 1 is free-standing and is preferably constructed of a heavy or dense material such as marble, ceramic or metal to facilitate stability when resting on a flat horizontal surface. The base plate 2 is provided with a concave rotation surface 29, from the center of which a tapered roll spindle 15 projects through the opening in the cylindrical core 23 of a paper roll 22 placed on the roll spindle 15. Accordingly, the paper roll 22 is allowed to rotate in a controlled fashion responsive to grasping of a paper sheet 8 and dispensing of the paper sheet 8, as well as additional paper sheets, if desired, from the paper roll 22 as outward and slightly upward pressure is applied to the paper sheet 8 to orient the paper roll 22 on the roll spindle 15 in the configuration illustrated in FIG. 12. Controlled rotation of the paper roll 22 is therefore facilitated by the reduction of pressure between the bottom peripheral edge of the paper roll 22 and the concave rotation surface 29 of the base plate 2. When it is desired to tear the paper sheet 8 or a successive string of paper sheets 8 from the paper roll 22, downward pressure is applied to the lead paper sheet 8 and the paper roll 22 is tilted, rocked or pivoted on the roll spindle 15 to the configuration illustrated in FIG. 13. This downward force applied to the paper sheet 8, thus increases friction between the peripheral bottom edge of the paper roll 22 and the concave rotation of surface 29, to retard further rotation of the paper roll 22 on the roll spindle 15 and facilitate tearing of the paper sheet 8 or successive lengths of paper sheet 8 from the paper roll 22, as further illustrated in FIG. 13. Additional control in dispensing paper from the paper roll 22 can be effected, if desired, by designing the roll spindle 15 in like manner to the shaped roll spindle 15 illustrated in FIGS. 1–4 and 8–10, with selected smooth, friction-enhancing areas and sharp or otherwise friction-inducing edges or areas, as heretofore described.

Figure 14:
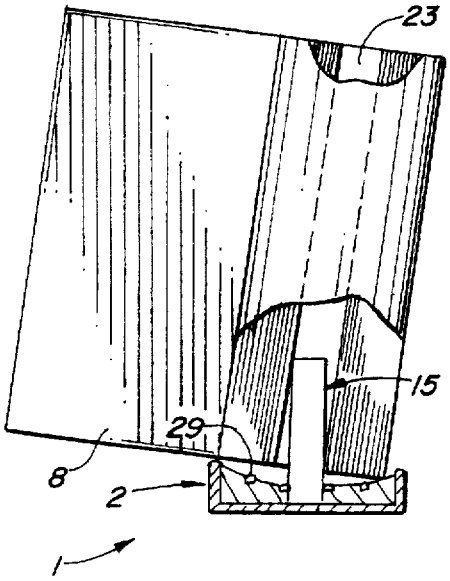
FIGS. 14 and 15 are side sectional views of a free-standing paper dispensing apparatus fitted with a short roll spindle.
Figure 15:
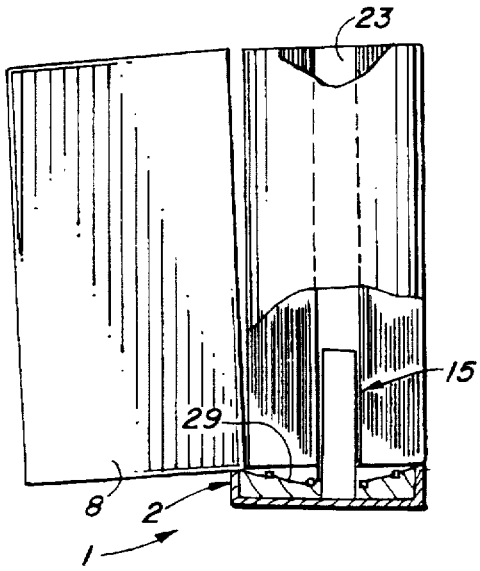

Referring to FIGS. 14 and 15 of the drawings, in yet another preferred embodiment of the invention the paper dispensing apparatus 1 is designed much in the same configuration as the paper dispensing apparatus 1 illustrated in FIGS. 12 and 13, except the roll spindle 15 is shorter than the length of the paper roll 22 and the cylindrical core 23. Accordingly, as in the case of the paper dispensing apparatus illustrated in FIGS. 12 and 13, the paper sheet 8 can be grasped by a user with outward and upward force applied to orient the paper roll 22 with respect to the roll spindle 15 as illustrated in FIG. 14 and facilitate controlled rotation of the paper roll 22 with respect to the base plate 2 and the roll spindle 15, until a desired length of paper sheet 8 is dispensed from the paper roll 2. Subsequent downward force applied to the paper sheet 8 tilts or pivots the paper roll 22 into the configuration illustrated in FIG. 15, thus engaging the bottom peripheral edge of the paper roll 22 with the concave rotation surface 29 of the base plate 2 and inducing friction, to retard further rotation of the paper roll 22. This action facilitates tearing of the paper sheet 8 or multiple lengths of the paper sheet 8, as desired, from the paper roll 2. Additional dispensing control may likewise be achieved in this embodiment by designing the roll spindle 15 with friction-enhancing and friction-inducing areas, in the manner described above.

Accordingly, it will be appreciated from a consideration of both the paper dispensing apparatus 1 illustrated in FIGS. 12 and 13 and FIGS. 14 and 15, that promoting and retarding of rotation of the paper roll 22 on the respective long and short roll spindles 15 is enhanced by contact between the bottom edge of the respective cylindrical cores 23 with the roll spindle 15 in each case, as illustrated in the drawings. This facility allows the paper roll 22 to slide up and down the roll spindles 15 for pressure adjustment, helps to bind the paper roll 22 on the roll spindles 15 as heretofore described, and retard rotation of the paper roll 22 on the roll spindles 15, in each case.

The roll dispensing apparatus 1 of this invention, in all of the embodiments described above, is particularly useful in preventing "streaming " of the paper sheet 8 when used by children, since the rocking or tilting action in all cases is easy to learn and extension of the paper sheet 8 from the roll dispensing apparatus 1 is not possible when the paper roll 22 is in the tearing, or "locked" positions illustrated in the drawings. Accordingly, the rocking or tilting action must be effected in light of the pulling inertia necessary to unwind and tear the paper sheet or sheets 8, considering the size and weight of the paper roll 22 and the height and design of the roll spindle 15. Other design features, such as a flexible roll spindle 15 which deforms responsive to hand tension on the paper sheet 8 in the tearing configuration, can also be implemented, as desired, if paper is to be easily removed from the paper roll 22. Furthermore, since the roll dispensing apparatus 1 of this invention is compact and easily mounted on a vertical or horizontal surface, multiple units of the roll dispensing apparatus 1 can be mounted side-by-side or in various areas with respect to each other, or a single unit with two or more roll spindles may be used, as illustrated in FIGS. 8 and 10, for dispensing various types of rolled paper products, as desired. Additionally, the roll dispensing apparatus 1 is most preferably constructed in one-piece of an injection-moldable plastic material such as ABS plastic, although the specific plastic composition may be selected by those skilled in the art. The roll dispensing apparatus 1 has no moving parts, is rugged and is conveniently designed for use in substantially any location and the preferred bevelled top surface 18 illustrated in FIGS. 1–4 especially facilitates easy and convenient insertion and removal of a roll of rolled paper product on the roll spindle 15. Moreover, the length, height, position and shape of the friction blade 6, friction strip 6*a* or alternative friction-inducing surface or element on selected surface areas of the base plate 2 can be altered to accommodate a paper roll 22 of any desired size and character.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A paper dispensing apparatus for dispensing paper from a rolled paper product, said paper dispensing apparatus comprising:

at least one roll spindle for receiving the rolled paper product, said roll spindle having a first end, a second end, a length, and a transverse cross section;

bracket means for supporting said roll spindle at said first end; and at least one elongated friction blade for frictionally engaging the rolled paper product provided on at least one of said roll spindle and said bracket means, wherein the transverse cross section of said roll spindle is sufficiently small and suitably shaped so that the rolled paper product may tilt relative to said roll spindle in a first direction when paper from the rolled paper product is pulled substantially perpendicularly to said roll spindle for dispensing, and said blade is positioned such that said tilt in said first direction substantially disengages the rolled paper product from said friction blade thereby allowing rotation of the rolled paper product on said roll spindle and dispensing of the paper, and wherein the transverse cross section of said roll spindle is sufficiently small and suitably shaped so that the rolled paper product may tilt relative to said roll spindle in a second direction when paper from the rolled paper product is pulled substantially toward said first end of said roll spindle for tearing, and said blade is positioned such that said tilt in said second direction substantially nonrotatably frictionally engages the rolled paper product with said friction blade thereby allowing tearing of dispensed paper from the rolled paper product.

2. The paper dispensing apparatus of claim 1 wherein said paper dispensing apparatus is mounted on a surface and said bracket means comprises a mounting bracket for securing said paper dispensing apparatus to the surface and a base plate extending from said mounting bracket at a selected angle with respect to said mounting bracket and wherein said roll spindle extends from said base plate and said friction blade is located on said base plate.

3. The paper dispensing apparatus of claim 2 wherein said selected angle is in the range of from about 75 degrees to about 90 degrees.

4. The paper dispensing apparatus of claim 3 wherein said roll spindle comprises a roll spindle having a substantially triangular cross-section and a triangular base adjacent to said friction blade.

5. The paper dispensing apparatus of claim 1 wherein said roll spindle is shorter than the rolled paper product.

6. The paper dispensing apparatus of claim 1 wherein said roll spindle is characterized by a selected polygonal cross-section.

7. The paper dispensing apparatus of claim 6 wherein said bracket means comprises a mounting bracket for securing said paper dispensing apparatus to a fixed surface and a base plate extending from said mounting bracket at a selected angle with respect to said mounting bracket and wherein said roll spindle extends from said base plate.

8. The paper dispensing apparatus of claim 7 wherein said base plate terminates in a downwardly-extending lip and said friction blade is mounted on said downwardly-extending lip of said base plate adjacent to said roll spindle.

9. A paper dispensing apparatus for receiving a rolled paper product, comprising:

a base plate;

a roll spindle extending upwardly from said base plate for receiving the rolled paper product; and at least one elongated friction blade for frictionally engaging the rolled paper product provided on said base plate, wherein the transverse cross section of said roll spindle is sufficiently small and suitably shaped so that the rolled paper product may tilt relative to said roll spindle in a first direction when paper from the rolled paper product is pulled substantially perpendicularly to said roll spindle for dispensing, and said blade is positioned such that said tilt in said first direction substantially disengages the rolled paper product from said friction blade thereby allowing rotation of the rolled paper product on said roll spindle and dispensing of the paper, and wherein the transverse cross section of said roll spindle is sufficiently small and suitably shaped so that the rolled paper product may tilt relative to said roll spindle in a second direction when,paper from the rolled paper product is pulled substantially toward said base plate for tearing, and said blade is positioned such that said tilt in said second direction substantially nonrotatably frictionally engages the rolled paper product with said friction blade thereby allowing tearing of dispensed paper from the rolled paper product.

10. The paper dispensing apparatus of claim 9 wherein said roll spindle is shorter than the rolled paper product.

11. The paper dispensing apparatus of claim 9 comprising a mounting bracket provided on said base plate for securing said paper dispensing apparatus to a vertical surface, said base plate extending from said mounting bracket at a non obtuse angle in the range of from about 75 degrees to about 90 degrees for mounting said roll spindle, and a downwardly-turned extending end terminating said base plate and for engaging the rolled paper product when said rolled paper product is tilted in said opposite direction.

12. The paper dispensing apparatus of claim 11 wherein said said non-obtuse angle is about 85 degrees.

13. A paper dispensing apparatus for dispensing paper from a rolled paper-product, comprising:

a base plate; and a roll spindle extending upwardly from said base plate for receiving the rolled paper product, said roll spindle having at least one friction-reducing area and at least one elongated friction blade for frictionally engaging the rolled paper product, wherein the transverse cross section of said roll spindle is sufficiently small and suitably shaped so that the rolled paper product may tilt relative to said roll spindle in a first direction when paper from the rolled paper product is pulled substantially perpendicularly to said roll spindle for dispensing, and said blade is positioned such that said tilt in said first direction substantially disengages the rolled paper product from said friction blade and substantially engages the rolled paper product with said friction-reducing area, thereby allowing rotation of the rolled paper product on said roll spindle and dispensing of the paper, and wherein the transverse cross section of said roll spindle is sufficiently small and suitably shaped so that the rolled paper product may tilt relative to said roll spindle in a second direction when paper from the rolled paper product is pulled substantially toward said base plate for tearing, and said blade is positioned such that said tilt in said second direction substantially nonrotatably frictionally engages the rolled paper product with said friction blade and substantially disengages the rolled paper product from said friction-reducing area, thereby allowing tearing of dispensed paper from the rolled paper product.

14. The paper dispensing apparatus of claim 13 further comprising means, provided on said base plate, for frictionally engaging the rolled paper product when the rolled paper product is tilted in said second direction.

15. A method for dispensing paper from a rolled paper product, comprising the steps of:

(1) placing the rolled paper product on a spindle of a paper dispensing apparatus, said paper dispensing apparatus comprising:

(a) at least one roll spindle for receiving the rolled paper product, said roll spindle having a first end, a second end, a length, and a transverse cross section sufficiently small and suitably shaped so that the rolled paper product may tilt relative to said roll spindle;

(b) bracket means for supporting said roil spindle at said first end; and (c) an elongated friction blade for frictionally engaging the rolled paper product provided on at least one of said roll spindle and said bracket means;

(2) pulling paper from the rolled paper product substantially perpendicularly to said roll spindle for dispensing, thereby tilting the rolled paper product in a first direction relative to said roll spindle, substantially disengaging the rolled paper product from said elongated friction blade, allowing rotation of the rolled paper product on said roll spindle, and dispensing the paper;

(3) pulling paper substantially toward said first end of said roll spindle for tearing, thereby tilting the rolled paper product in a second direction relative to said roll spindle, substantially nonrotatably frictionally engaging the rolled paper product with said elongated friction blade, and tearing dispensed paper from the rolled paper product.

16. A method for dispensing paper from a rolled paper product as recited in claim 15, wherein said friction blade is provided on said bracket means.

17. A method for dispensing paper from a rolled paper product as recited in claim 15, wherein said elongated friction blade is provided on said roll spindle, and said roll spindle is further provided with at least one friction-reducing area for rotatably engaging the rolled paper product when the rolled paper product is tilted in said first direction.

18. A method for dispensing paper from a rolled paper product as recited in claim 17, wherein said bracket means is provided with means for frictionally engaging the rolled paper product.

* * * * *